US010973381B2

(12) United States Patent
Lim et al.

(10) Patent No.: US 10,973,381 B2
(45) Date of Patent: Apr. 13, 2021

(54) VACUUM CLEANER

(71) Applicant: LG Electronics Inc., Seoul (KR)

(72) Inventors: Hwajin Lim, Seoul (KR); Seongho Park, Seoul (KR); Youngho Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 10 days.

(21) Appl. No.: 15/705,532

(22) Filed: Sep. 15, 2017

(65) Prior Publication Data

US 2018/0084963 A1 Mar. 29, 2018

(30) Foreign Application Priority Data

Sep. 29, 2016 (KR) ..... 10-2016-0125516

(51) Int. Cl.

| | |
|---|---|
| ***A47L 9/16*** | (2006.01) |
| ***A47L 9/10*** | (2006.01) |
| ***A47L 9/24*** | (2006.01) |
| ***A47L 5/36*** | (2006.01) |

(52) U.S. Cl.

CPC ..... *A47L 9/1691* (2013.01); *A47L 5/362* (2013.01); *A47L 9/106* (2013.01); *A47L 9/165* (2013.01); *A47L 9/1608* (2013.01); *A47L 9/1633* (2013.01); *A47L 9/1641* (2013.01); *A47L 9/1683* (2013.01); *A47L 9/242* (2013.01)

(58) Field of Classification Search

CPC ..... A47L 17/0019; A47L 19/1409
USPC ..... 292/16, 28, 38, 171, 322; 15/327.1
See application file for complete search history.

(56) References Cited

U.S. PATENT DOCUMENTS 3,812,659 A * 5/1974 Westergren ..... A47L 9/00 285/319
4,150,464 A * 4/1979 Tracy ..... A44B 11/266 24/196
4,586,214 A * 5/1986 Berfield ..... A47L 5/362 15/327.2

(Continued)

FOREIGN PATENT DOCUMENTS

CN 101133225 2/2008
CN 102415855 4/2012

(Continued)

OTHER PUBLICATIONS

Translation of JP2004290337.*

(Continued)

*Primary Examiner* — Bryan R Muller
*Assistant Examiner* — Thomas Raymond Rodgers
(74) *Attorney, Agent, or Firm* — Fish & Richardson P.C.

(57) ABSTRACT

A vacuum cleaner according to an aspect includes a case defining a dust collecting space in which dust is stored and having a boss, a dust container cover rotatably connected to the case and configured to open/close the dust collecting space, and an opening/closing part configured to open the dust container cover, wherein the dust container cover has a cover locker having a rib caught by the boss, the opening/closing part includes a pair of push parts installed in the case and elastically deformed by a user, and the rib is spaced apart from the boss as the cover locker is deformed while the pair of push parts are moved in a direction in which the push parts become closer to each other.

20 Claims, 15 Drawing Sheets

(56) References Cited

U.S. PATENT DOCUMENTS

| | | | | |
|---|---|---|---|---|
| 5,107,567 | A * | 4/1992 | Ferrari | A47L 5/28 15/344 |
| D345,293 | S * | 3/1994 | Bell | D8/331 |
| 5,348,356 | A * | 9/1994 | Moulton | E05B 37/20 292/80 |
| 6,478,346 | B1 * | 11/2002 | Veser | B01D 46/0004 292/19 |
| 7,681,288 | B1 * | 3/2010 | Giampavolo | A44B 11/2573 24/614 |
| 8,370,993 | B2 * | 2/2013 | Conrad | A47L 5/225 15/327.6 |
| 8,684,422 | B2 * | 4/2014 | Liang | G06F 1/1616 292/80 |
| 2005/0138758 | A1 * | 6/2005 | Lee | A47L 5/362 15/327.2 |
| 2015/0223657 | A1 * | 8/2015 | Choe | A47L 9/1683 15/347 |
| 2016/0174787 | A1 * | 6/2016 | Conrad | A47L 5/24 15/329 |
| 2018/0084963 | A1 | 3/2018 | Lim et al. | |
| 2018/0235418 | A1 * | 8/2018 | Lauer | A47L 5/24 |

FOREIGN PATENT DOCUMENTS

| | | | |
|---|---|---|---|
| CN | 103142190 | | 6/2013 |
| CN | 103371776 | | 10/2013 |
| CN | 203740307 | | 7/2014 |
| CN | 203954599 | | 11/2014 |
| CN | 208160582 | U | 11/2018 |
| JP | 2004290337 | | 10/2004 |
| JP | 2004290337 | A * | 10/2004 |
| JP | 2015120057 | | 7/2015 |
| KR | 100560327 | | 3/2006 |
| KR | 10-2012-0031446 | | 4/2012 |
| KR | 10-2015-0004630 | | 1/2015 |
| KR | 10-2015-0009251 | | 1/2015 |
| KR | 20150004630 | | 1/2015 |
| KR | 20160006543 | | 1/2016 |

OTHER PUBLICATIONS

International Search Report in International Application No. PCT/KR2017/007619, dated Nov. 10, 2017, 3 pages (with partial English translation).

Australian Office Action in Australian Application No. 2017337522, dated Mar. 10, 2020, 4 pages.

Chinese Office Action in Chinese Appln. No. 201780059935.9, dated Sep. 10, 2020, 17 pages (with English translation).

Chinese Office Action in Chinese Application No. 201780059935.9, dated Feb. 19, 2021, 10 pages (with Machine translation).

* cited by examiner

VACUUM CLEANER

CROSS-REFERENCE TO RELATED APPLICATIONS

This application claims priority under 35 U.S.C. 119 and 35 U.S.C. 365 to Korean Patent Application No. 10-2016-0125516 filed on Sep. 29, 2016 in Korea, the entire contents of which is hereby incorporated by reference in its entirety.

BACKGROUND

The present disclosure relates to a vacuum cleaner.

In general, a vacuum cleaner is a device that suctions air including dust using suction force generated by a suction motor mounted inside a body, and then filters the dust inside the body.

Such a vacuum cleaner is classified into a manual cleaner and an automatic cleaner. The manual cleaner is a cleaner by which a user directly performs cleaning, and the automatic cleaner is a cleaner which performs cleaning while being driven by itself.

The manual cleaner may be classified into a canister type cleaner in which a suction nozzle is provided separately from a body and is connected to the body through a connection tube and an upright type cleaner in which a suction nozzle is coupled to a body.

Meanwhile, regardless of the types, the cleaner includes a dust container in which dust suctioned into a cleaner body through the suction nozzle is stored, and the user should periodically empty the dust container, in which the dust is stored, to maintain suction force of the cleaner.

When the user empties the dust container, the dust container is separated from the cleaner body, the dust container is opened, and the internal dust is shaken out of the dust container.

A dust container assembling device for a cleaner is disclosed in Korean Patent No. 10-0751788 (2007.08.24) as the prior art.

According to the prior art, while the dust container is opened, hands of the user may be polluted by the dust stored in the dust container. Further, the dust container may be unintentionally opened.

Further, while the dust container is opened, the user should hold the dust container by one hand, and open the dust container by the other hand. Here, when a hand opening the dust container is not a mainly used hand (a right hand of a right-handed person or a left hand of a left-handed person), it is impossible for the user to apply proper force, and thus, the user may experience difficulty that the dust container may be dropped.

Meanwhile, when the dust container is designed to be easily used by the right-handed person such that the dust container is held by a left hand and the dust container is opened by a right hand, the left-handed person may feel inconvenience in opening the dust container.

Further, because a structure configured to open/close the dust container includes an elastic member having a form of a coil spring, it is difficult to assemble the structure configured to open/close the dust container.

SUMMARY

An aspect of the present disclosure is to provide a vacuum cleaner in which an opening/closing mechanism configured to open/close a dust container is easily assembled.

Further, another aspect of the present disclosure is to provide a vacuum cleaner in which the opening/close mechanism may be easily manipulated.

Further, another aspect of the present disclosure is to provide a vacuum cleaner in which the dust container may be easily opened by any one of both hands.

A vacuum cleaner according to an aspect may include a cleaner body, a suction device configured to guide air including dust to the cleaner body, and a dust container configured to store dust suctioned through the suction device, wherein the dust container includes a case, and a dust container cover rotatably connected to the case, and configured to open/close a dust collecting space.

The case may have a boss. A cover locker having a rib caught by the boss may be provided in the dust container cover.

The cover locker may extend upwards from the dust container cover.

An opening/closing part configured to open the dust container cover may be provided in the dust container cover. The opening/closing part may include a pair of elastically deformed push parts.

When the pair of push parts are elastically deformed in a direction in which the push parts become closer to each other, the cover locker is deformed by the pair of push parts, so that the rib and the boss are spaced apart from each other, and thus catching between the boss and the rib may be released.

The cover locker may be deformed in a direction in which the cover locker becomes farther away from the case.

The opening/closing part may further include a body part, and the pair of push parts may extend downwards from opposite sides of the body part.

A guide rib configured to fix locations of the pair of push parts, and restrain the pair of push parts from being deformed in a direction in which the push parts become farther away from each other may be provided in the case.

The guide rib may include a first rib and a second rib and a third rib extending downwards from an end of the first rib. The pair of push parts may be located between the second rib and the third rib.

Each of the pair of push parts may include an extending from the body part and a contact part provided at an end of the extension.

A left-right width of the contact part may be larger than a left-right width of the extension, and a minimum interval between the contact parts of the push parts may be smaller than a minimum interval between the extensions of the push parts.

The cover locker may include a guide in contact with the pair of contact parts.

Each of the pair of contact parts may have an inclined surface, and inclined surfaces in contact with the inclined surfaces of the contact parts may be formed on opposite sides of the guide.

The inclined surfaces of the contact parts may be inclined in a direction in which the inclined surfaces become closer to the case as the contact parts become closer to each other.

The dust container according to the present invention may further include a fixing part fixing the opening/closing part to the case and covering a portion of the opening/closing part.

BRIEF DESCRIPTION OF THE DRAWINGS

Embodiments will be described in detail with reference to the following drawings in which like reference numerals refer to like elements, and wherein.

DETAILED DESCRIPTION OF THE EMBODIMENTS

Hereinafter, detailed embodiments of the present disclosure will be described with reference to the accompanying drawings. However, the spirit of the present disclosure is not limited to proposed embodiments, and those skilled in the art who understands the spirit of the present disclosure may easily propose other embodiments within the same scope of the spirit.

Figure 1:
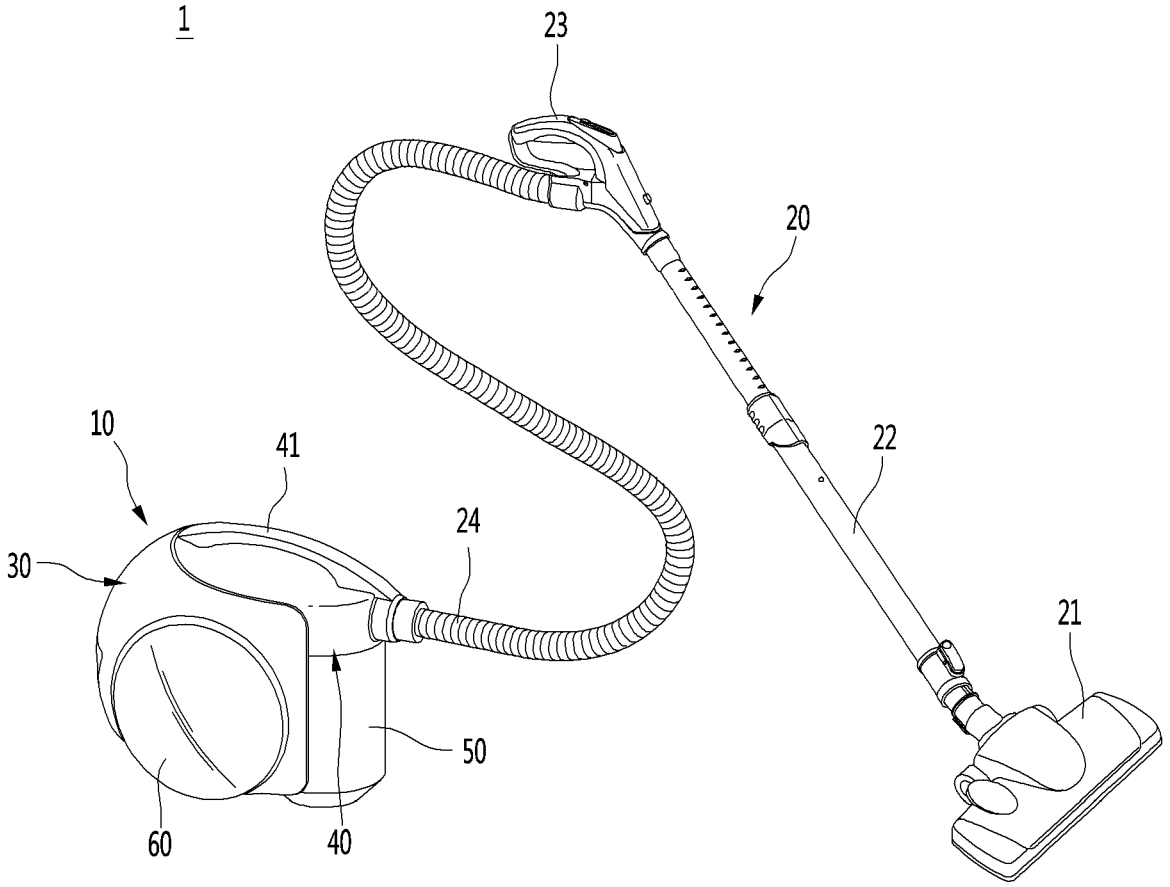
FIG. 1 is a perspective view illustrating a vacuum cleaner according to an embodiment of the present disclosure.
Figure 2:
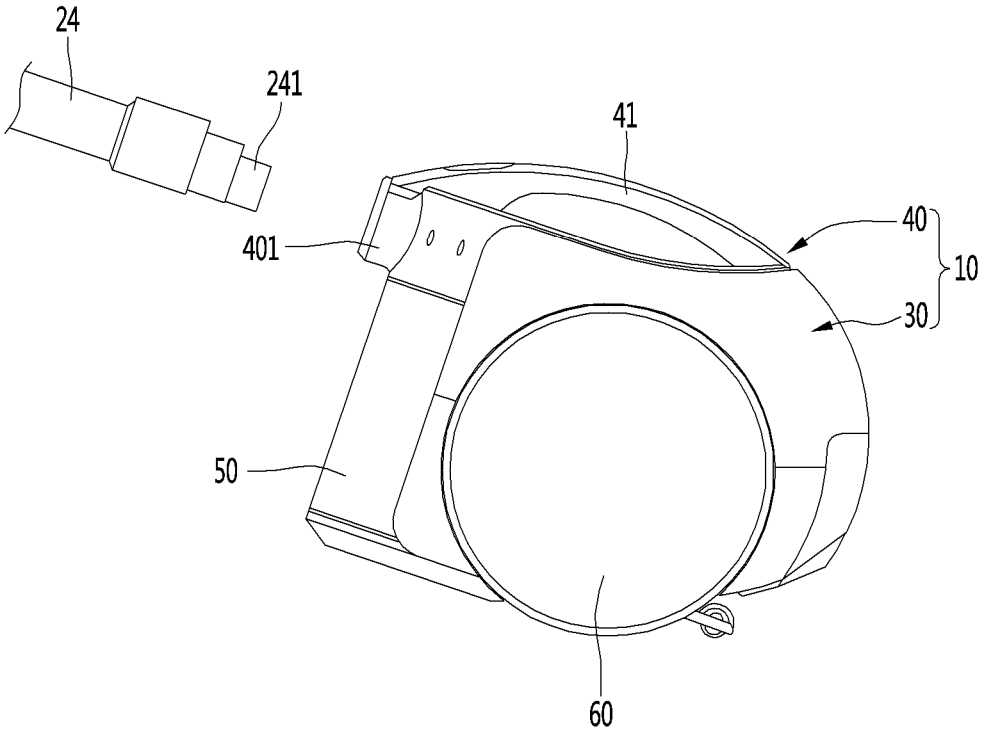
FIG. 2 is a view illustrating a state in which a cleaner body and a suction device are separated from each other according to the embodiment of the present disclosure.
Figure 3:
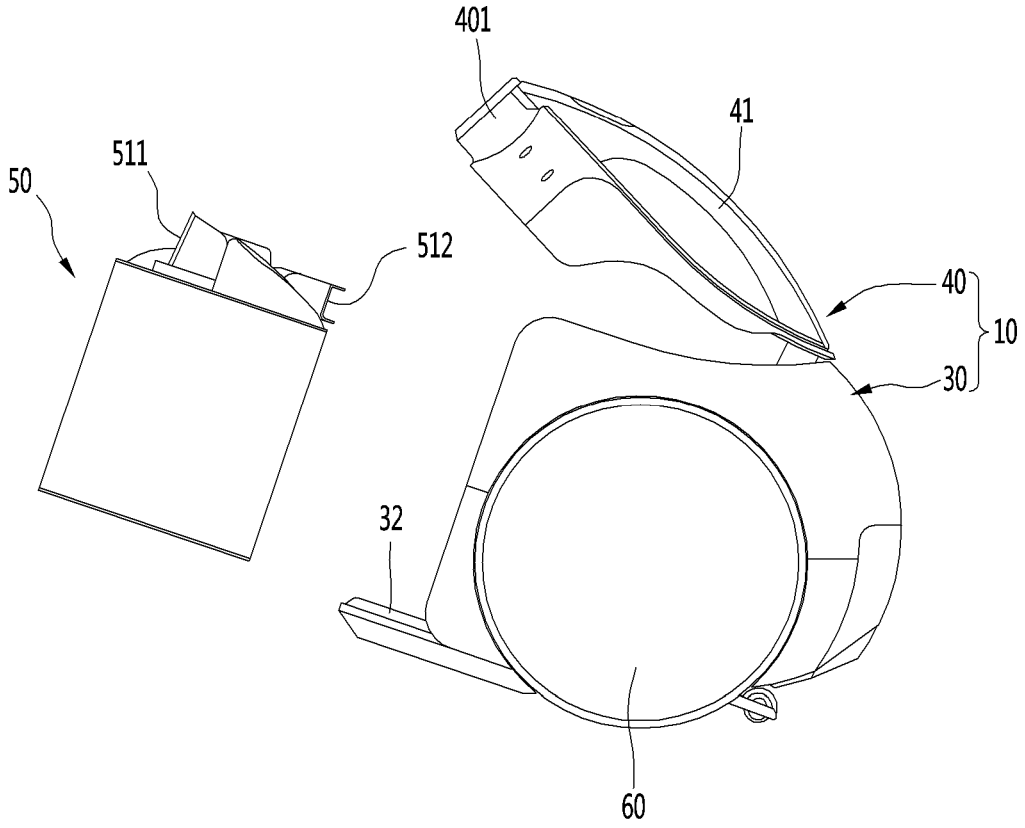
FIG. 3 is a view illustrating a state in which a dust container is separated from the cleaner body according to the embodiment of the present disclosure.
Figure 4:
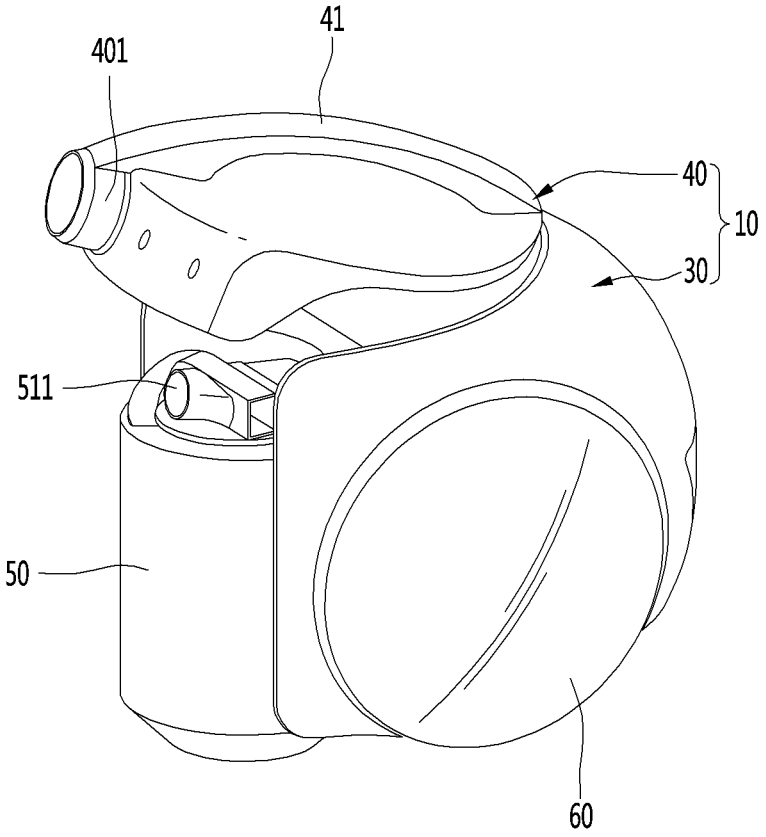
FIG. 4 is a view illustrating a state in which a cover member is opened according to the embodiment of the present disclosure.

FIG. 1 is a perspective view illustrating a vacuum cleaner according to an embodiment of the present disclosure, and FIG. 2 is a view illustrating a state in which a cleaner body and a suction device are separated from each other according to the embodiment of the present disclosure. FIG. 3 is a view illustrating a state in which a dust container is separated from the cleaner body according to the embodiment of the present disclosure, and FIG. 4 is a view illustrating a state in which a cover member is opened according to the embodiment of the present disclosure.

Referring to FIGS. 1 to 4, a vacuum cleaner 1 according to an embodiment of the present disclosure may include a cleaner body 10 and a suction device 20.

A suction motor (not illustrated) configured to generate suction force may be provided inside the cleaner body 10. Further, when the suction motor is driven to generate suction force, the suction device 20 may guide air including dust to the cleaner body 10.

The suction device 20 may include a suction part 21 configured to suction dust on a surface to be cleaned, for example, a bottom surface, and a connection part configured to connect the suction part 21 to the cleaner body 10.

The connection part may include an extension tube 22 connected to the suction part 21, a handle 23 connected to the extension tube 22 and a suction hose 24 configured to connect the handle 23 to the cleaner body 10.

A fitting part 241 configured to improve airtightness when being coupled to a connector 401 of the cleaner body 10 may be provided in the suction hose 24.

The fitting part 241 may attach/detach the suction hose to/from the connector 401. As illustrated, the fitting part 241 may be formed in multiple stages.

The cleaner body 10 may include a main body 30 defining an overall outer appearance and a cover member 40.

The cleaner body 10 may further include movable wheels 60 rotatably coupled to the main body 30. The pair of movable wheels 60 may be provided and may be coupled to opposite sides of the main body 30. Further, the movable wheels 60 may support the main body 30 such that the main body 30 may be rotated about a center of rotation of the movable wheels 60.

A grip part 41 to be gripped by a user may be provided in the cover member 40. The user may grip the grip part 41 when he/she wants to lift up or tilt the main body 30 or when the cover member 40 is opened/closed.

The cleaner body 10 may further include a dust container 50 in which the dust suctioned through the suction device 20 is stored. Although the dust container 50 may be formed to have a cylindrical shape as illustrated, the dust container 50 is not limited to such a shape. Further, the dust container 50 may be detachably provided on a front surface of the main body 30.

The dust container 50 may be detachably mounted on a seating part 32 provided on a front side of the main body 30. The dust container 50 may define a portion of the front surface of the main body 30 while being mounted on the seating part 32. Further, the dust container 50 may be detached/attached by opening/closing the cover member 40.

A suction port 511 through which the dust is suctioned may be provided in dust container 50. As illustrated, the suction port 511 may be arranged on an upper surface of the dust container 50. Accordingly, air introduced into the suction port 511 is guided to the lower side and is moved to a dust collecting space inside the dust container 50.

At least portions of side surfaces of the dust container 50 may be formed of a transparent material such that the dust collected in the dust collecting space may be identified.

In a state in which the dust container 50 is seated on the seating part 32, the side surfaces may be exposed through the front surface of the main body 30. Here, the exposed portions of the dust container 50 extend from upper ends to lower ends of the transparent side surfaces. Actually, the entire dust collecting space in which the dust is collected may be identified without separating the dust container 50.

A dust separating structure configured to separate the air and the dust suctioned by the suction device 20 from each other may be provided inside the dust container 50, and the dust separated by the dust separating structure may be collected on a lower side of the dust container 50.

The connector 401 may be directly connected to the suction hose 24 so that the air including the dust may be introduced into the connector 401. That is, one side of the connector 401 is coupled to the suction hose 24 and the other side of the connector 401 is aligned with the suction port 511. Accordingly, the connector 401 connects the suction hose 24 and the suction port 511 to each other.

The connector 401 may communicate with the dust container 50. Accordingly, the air introduced into the suction hose 24 may be introduced into the dust container 50 via the connector 401.

The suction port 511 through which the dust is introduced may be provided on one side of the dust container 50. As illustrated, the suction port 511 may be provided on an upper side of the dust container 50. Further, the suction port 511 may be arranged to face the front side. Here, the front side refers to a portion in which the suction hose 24 is located with respect to the cleaner body 10.

The connector 401 may be arranged on an upper side of the dust container 50. As both the suction port 511 and the connector 401 are arranged on the upper side of the dust container 50, a passage length of air introduced from the suction hose 24 may be minimized.

The cleaner body 10 may further include the cover member 40 movably provided in the main body 30. The cover member 40 may define at least a portion of the upper surface of the cleaner body 10, and may be configured to open/close the upper surface of the main body 30. Here, the cover member 40 may be rotated while a rear end of the cover member 40 is shaft-coupled to the main body 30, and may be opened as the user grips the grip part 41 to rotate the grip part 41.

The connector 401 may be provided in the cover member 40. Thus, the connector 401 may be moved together with the cover member 40. The cover member 40 may shield at least one side of the dust container 50. The cover member 40 may be coupled to the dust container 50 while shielding at least one side of the dust container 50. When the cover member 40 is closed, the cover member 40 may be coupled to the dust container 50, and when cover member 40 is opened, the cover member 40 may be separated from the dust container 50. As an example, the cover member 40 may be coupled to an upper portion of the dust container 50.

In a state in which the cover member 40 is closed, the fitting part 241 of the suction hose 24 connected to the connector 401 of the cover member 40 may communicate with the suction port 511 of the dust container 50. Thus, the dust and the air suctioned through the suction device 20 may pass through the connector 401 of the cover member 40 and may be introduced into the dust container 50 through the suction port 511.

Further, in a state in which the cover member 40 is opened, a state in which the fitting part 241 of the suction hose 24 is connected to the connector 401 of the cover member 40 may be maintained, and the cover member 50 and the dust container 50 may be separated from each other. Thus, in a state in which the cover member 40 is opened, the dust container 50 may be separated from the seating part 32.

Figure 5:
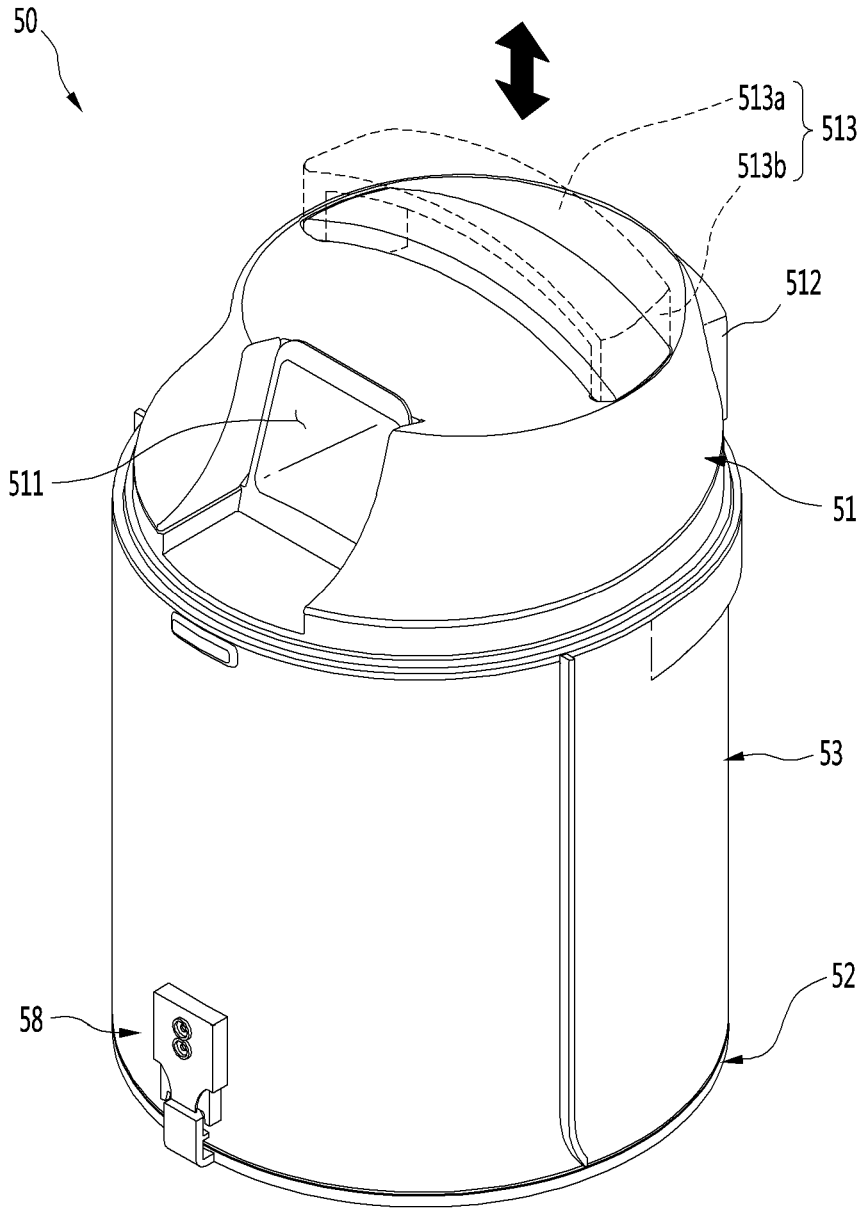
FIG. 5 is a perspective view illustrating the dust container according to the embodiment of the present disclosure.
Figure 6:
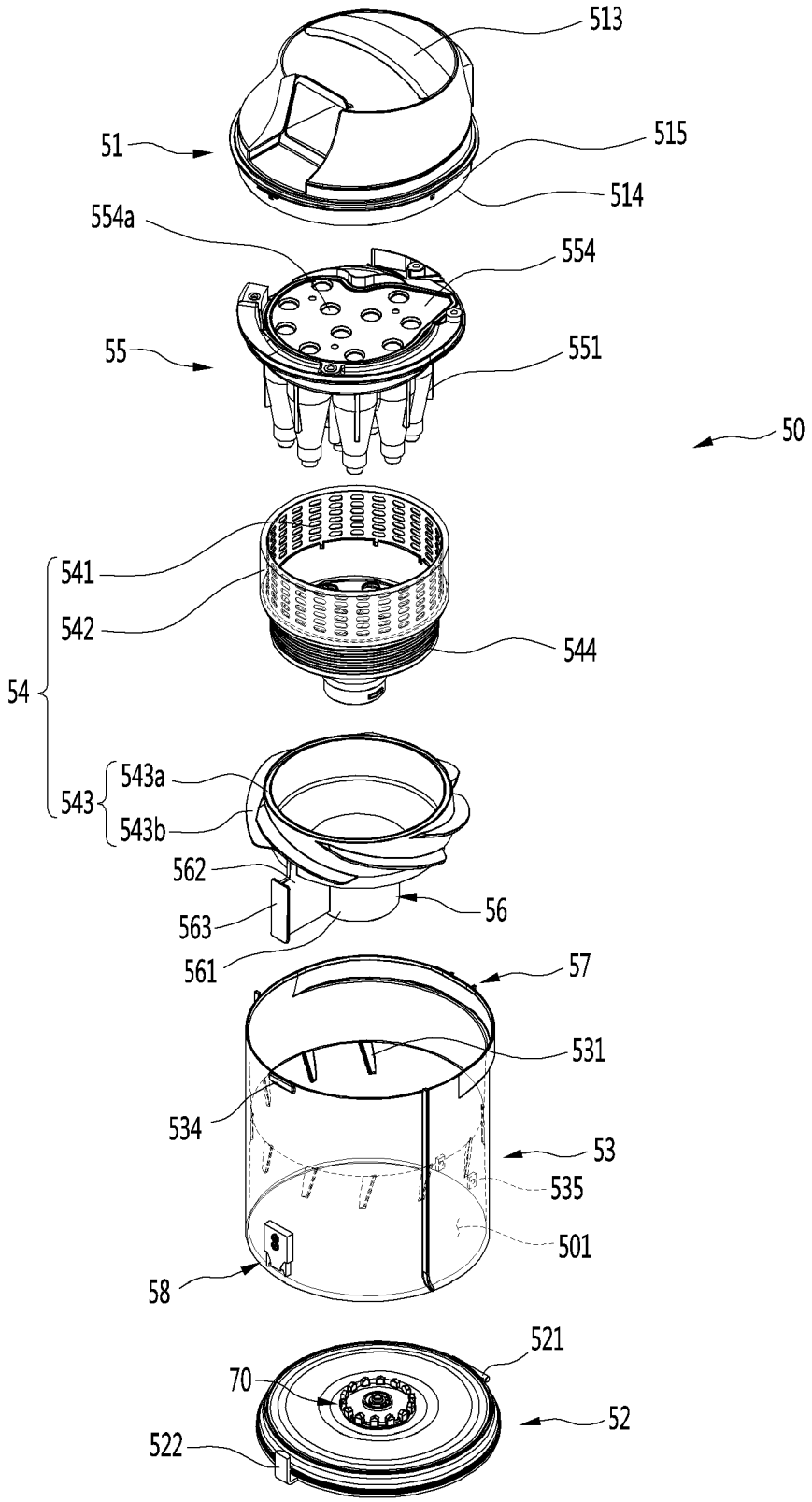
FIG. 6 is an exploded perspective view illustrating the dust container of FIG. 5.

FIG. 5 is a perspective view illustrating the dust container according to the embodiment of the present disclosure, and FIG. 6 is an exploded perspective view illustrating the dust container of FIG. 5.

Referring to FIGS. 5 and 6, the dust container 50 may separate the dust from the air introduced through the suction device 20 and store the dust.

The air suctioned to the dust container may be filtered sequentially by a first cyclone 54 and a second cyclone 55, may be discharged through a discharge port 512, and then may be introduced into the main body 30.

The dust container 50 may include an overall cylindrical case 53, an upper cover 51 configured to open/close an opened upper end of the case 53, and a dust container cover 52 configured to open/close an opened lower end of the case 53.

A portion of the case 53 or the entire case 53 may be formed to be transparent. The first cyclone 54 and the second cyclone 55 may be accommodated inside the case 53.

In detail, the upper cover 51 defines an outer appearance of an upper surface of the dust container 50, and may be shielded by the cover member 40 while being mounted on the main body 30. Further, the suction port 511 is formed on a front side of the dust container 50. Further, the suction port 511 communicates with the connector 401 in a state in which the cover member 40 is closed, and introduces the air including the dust, suctioned through the suction device 20, into the dust container 50.

Further, a not-illustrated passage guide may be provided inside the upper cover 51. The air introduced through the suction port 511 may be guided by the passage guide to flow downwards.

The discharge port 512 is formed on a rear side of the upper cover 51, which is opposite to the suction port 511. The discharge port 512 allows the air, from which the dust is filtered as the air passes through the first cyclone 54 and the second cyclone 55 inside the dust container 50, to be discharged to the outside of the dust container 50.

Meanwhile, a dust container handle 513 that may be withdrawn upwards may be provided on an upper surface of the upper cover 51. The dust container handle 513 may include a handle 513*a* extending in a transverse direction such that the user may grip the handle 513*a* and a side extension 513*b* vertically extending from opposite ends of the handle 513*a*.

The side extension 513*b* may be inserted into the upper cover 51, and at this time, the handle 513*a* may be in close contact with the upper surface of the upper cover 51. In a state in which the dust container 50 is mounted, a state in which the dust container handle 513 is inserted is maintained by a self-weight thereof, and the dust container handle 513 is not interfered when the cover member 40 is opened/closed.

Further, an upper cover inserting part 514 extending downwards along a circumference of the upper cover 51 is formed at a lower end of the upper cover 51. An upper gasket 515 is provided in the upper cover inserting part 514 so that airtightness of the case 53 may be achieved in a state in which the upper cover 51 is mounted on the case 53.

A state in which the upper cover 51 is coupled to the case 53 is maintained by an upper locker 57, which will be described below.

The dust container cover 52 may shield an opened lower surface of the case 53. A gasket is provided along a circumference of the dust container cover 52, and in a state in which the dust container cover 52 is closed, the dust container cover 52 is in close contact with the case 53, thereby achieving airtightness between the case 53 and the dust container cover 52.

Further, a transfer gear 70 may be provided at a center of the dust container cover 52. The transfer gear 70 connects a compression motor assembly (not illustrated) provided in the cleaner body 10 and a dust compression unit 56 located in the case 53 to transfer power such that the dust compression unit 56 may be driven by driving the compression motor assembly.

One side of the dust container cover 52 may be shaft-coupled to a lower end of the case 53, and the dust container cover 52 may be opened/closed through rotation to empty the dust. The dust container cover 52 may include a cover locker 522 for coupling with the case 53. Further, the dust container cover 52 may be coupled to or uncoupled from the case 53 by an opening/closing mechanism 58, which will be described below.

Thus, the dust container cover 52 may be selectively opened/closed by manipulating the opening/closing mechanism 58.

Further, the first cyclone 54 may filter foreign substances and dust from the introduced air, and may introduce the air, from which the foreign substances and the dust are filtered, into the inner side. The first cyclone 54 may include a cylindrical strainer 541 having a plurality of holes formed therein, and a dust filter 542 provided outside or inside the strainer 541.

Thus, the air introduced along the case 53 may be introduced into the inside of the strainer 541, may be dropped downwards, may pass through a guide unit 543, and then may be stored in a first dust collecting space 501 below the dust container 50.

Meanwhile, fine dust not filtered by the dust filter 542 may be introduced into the second cyclone 55 and may be separated.

The second cyclone 55 may be accommodated in the strainer 541 and may include a plurality of casings 551 having a conic shape that is narrowed as it goes downwards.

As upper ends of the casings 551 and lower ends of the casings 551 are opened, the fine dust is separated from the air while the suctioned air is rotated inside the casings 551, and is discharged to the lower side, and the air separated from the fine dust flows to the upper side. The fine dust separated by the casings 551 may be stored in a second dust collecting space (not illustrated) separated from the first dust collecting space 501.

An inlet (not illustrated) through which the air may be introduced may be formed above the casings 551.

Further, the second cyclone 55 may further include a cyclone cover 554 configured to cover upper surfaces of the plurality of casings 551. Air outlets 554*a* through which the air separated from the dust through the plurality of casings 551 is discharged are formed in the cyclone cover 554.

The air discharged to the upper side through the air outlets 554*a* may flow through the upper cover 51, and may be discharged to the outside of the main body 30 after flowing along an inside of the main body 30 through the discharge port 512.

The inner case 544 may support the first cyclone 54 and the second cyclone 55, and at the same time, may partition and define the first dust collecting space 501 and the second dust collecting space (not illustrated).

The inner case 544 may have a cylindrical shape, an upper surface and a lower surface of which are opened, wherein the diameter of a lower portion thereof is smaller than the diameter of an upper portion thereof. Thus, a space between the inner case 544 and the case 53 may be defined as the first dust collecting space 501 in which the dust separated by the first cyclone 54 is stored, and a space inside the inner case 544 may be defined as the second dust collecting space (not illustrated) (an internal space of a rotary part 561, which will be described below) in which the dust separated by the second cyclone 55 is stored.

The diameter of the upper portion of the inner case 544 is narrowed as it goes downwards, and lower portions of the casings 551 may be accommodated in the upper portion of the inner case 544.

The guide unit 543 may be moved downwards while spirally rotating when the dust and the air separated from each other through the first cyclone 54 flow downwards, and may include a guide base 543*a* mounted to an outside of the inner case 544 and vanes 543*b* protruding from the guide base 543*a*.

The guide base 543*a* may have a cylindrical shape, and may be arranged outside the inner case 544. The guide base 543*a* may be coupled to the inner case 544 or may be formed integrally with the inner case 544. Further, the guide base 543*a* may be rotatably mounted on the outside of the inner case 544. Further, the guide base 543*a* may be configured integrally with the dust compression unit 56.

The vanes 543*b* may be formed along an outer circumference of the guide base 543*a*, and may be inclined to force a flow direction of the dust and the air to a spiral direction. Here, the plurality of vanes 543*b* may be arranged such that at least portions of neighboring vanes 534*b* overlap each other when viewed from above, and the dust and the air may pass through a passage formed between the neighboring vanes 543*b* to move downwards.

The dust guided by the vanes 543*b* may pass through the vanes 543*b*, and then may be stored inside the first dust collecting space 501. Further, the dust stored in the first dust collecting space 501 may not flow backwards in a reverse direction and stay in the first dust collecting space 501 due to the structures of the vanes 543*b* formed to be inclined and arranged to vertically overlap each other.

In particular, backflow blocking parts 531 are formed on an inner surface of the case 53, which corresponds to areas of the vanes 543*b*. The backflow blocking parts 531 may be arranged along an inner circumference of the case 53 at a specific interval. The backflow blocking parts 531 may be formed to have shapes of ribs extending in directions that intersect the vanes 543*b*.

Thus, a portion of the dust, which flows backwards in the first dust collecting space 501, collides with the backflow blocking parts 531 through which the dust passes while the vanes 543*b* are rotated. Thus, the portion of the dust fails to pass through the vanes 543*b*, is dropped downwards in turn, and is primarily compressed. That is, a portion of the dust, which flows upwards, is consistently and repeatedly dropped by the vanes 543*b* and the backflow blocking parts 531, and is compressed while colliding with other dust.

The dust compression unit 56 is located below the inner case 544, and compresses the dust stored inside the first dust collecting space 501 through rotation to reduce the volume of the dust.

In detail, the dust compression unit 56 may include the rotary part 561 and a compression part 562. The rotary part 561 has a cylindrical shape, and is mounted on an outside of the inner case 544. The rotary part 561 may be independently rotated depending on a coupling state with the inner case 544, and may be rotated together with the inner case 544 Of course, when the rotary part 561 is coupled to the guide unit 543, the rotary part 561 may be rotated together with the guide unit 543.

The compression part 562 may be formed from one side of the rotary part 561 to an inner surface of the case 53 to cross the first dust collecting space 501.

The compression part 562 may be formed to have a shape of a plate corresponding to a cross section of the first dust collecting space 501, to partition an inside of the first dust collecting space 501. An inner wall (not illustrated) extending inwards to overlap the compression part 562 may be formed inside the first dust collecting space 501. Thus, the dust stored in the first dust collecting space 501 may be compressed between the compression part 562 and the inner wall by forward/reverse rotation of the compression part 562. That is, the dust stored inside the first dust collecting space 501 is secondarily compressed by rotation of the compression part 562.

A plurality of ventilation holes 562*a* are formed in the compression part 562, so that air resistance that may be generated while the compression part 562 is rotated may be resolved, and pressure imbalance of spaces partitioned by the compression part 562 may be resolved. Further, a decoration member 563 that is in contact with an inner surface of the case 53 may be mounted to an extending end of the compression part 562. The decoration member 563 may be formed to have a quadrangular shape that is in surface contact with the case 53 to shield the compression part 562 and the case 53 from each other. Further, the decoration member 563 may be formed of a wear-resistant material, and may be formed of a lubricative material to make the rotation of the compression part 562 smooth.

Meanwhile, a supporting rib 532 may be formed on an outer surface of the case 53. The supporting rub 532 may extend from an upper end to a lower end of the case 53. Further, when the dust container 50 is mounted, the supporting rib 532 is in contact with opposite left and right ends of an opened front surface of the main body 30 to guide accurate mounting of the dust container 50.

Figure 7:
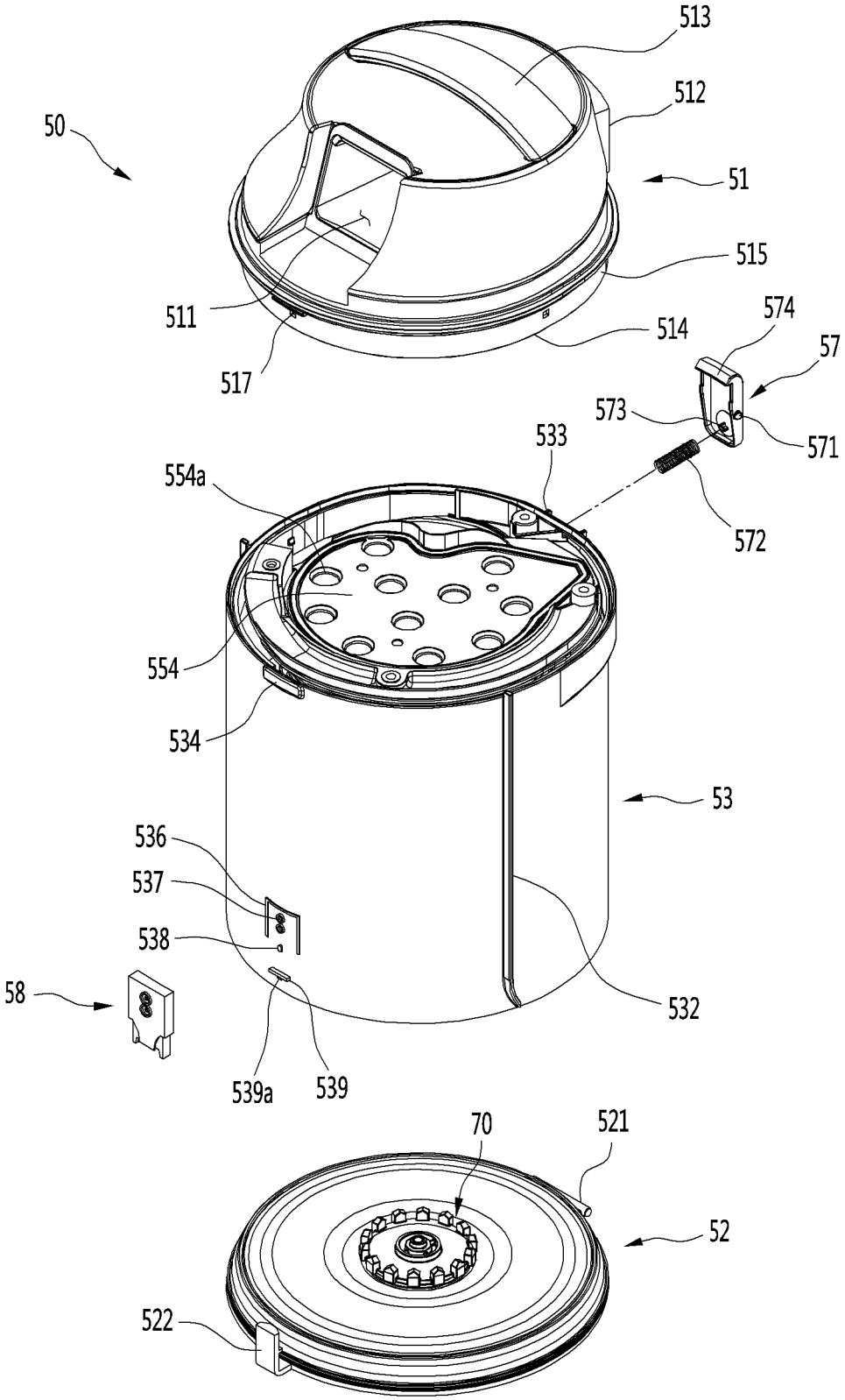
FIG. 7 is a perspective view illustrating a state in which an upper cover, a dust container cover, an upper locker and an opening/closing mechanism are separated from the dust container.

FIG. 7 is a perspective view illustrating a state in which an upper cover, a dust container cover, an upper locker and an opening/closing mechanism are separated from the dust container.

Referring to FIG. 7, the upper end of the case 53 may be opened/closed by the upper cover 51, and the lower end of the case 53 may be opened/closed by the dust container cover 52.

A state in which the upper cover 51 is restrained to the case 53 may be maintained by the upper locker 57. Further, when the dust container 50 is cleaned while being disassembled into internal configurations or when maintenance of the dust container 50 is required, the upper cover 51 may be separated from the case 53 by manipulating the upper locker 57.

The upper locker 57 may be mounted on an upper locker mounting part 533 formed at an upper end of the case 53. Here, in a state in which a rotary locker shaft 571 protruding sideward from opposite surfaces of the upper locker 57 is inserted into and mounted to a locker hole (not illustrated) on the upper locker mounting part 533, rotation of the upper locker 57 may be manipulated.

Further, a locker spring 572 may be provided between the upper locker and the upper locker mounting part 533 below the rotary locker shaft 571, and a lower portion of the upper locker 57 may be elastically supported by a spring mounting part 573 and a spring guide (not illustrated).

The upper locker 57 may extend beyond an upper end of the case 53, and a hook 574 protruding in a shape of a hook may be formed at an extending end of the upper locker 57. The hook 574 may be inserted into a hook restraining part (not illustrated) of the upper cover 51 while the upper cover 51 is mounted thereon, so that the hook 574 and the hook restraining part (not illustrated) may be caught and restrained by each other.

An upper boss 517 may be formed on one side of the upper cover 51, which is opposite to the hook restraining part (not illustrated), and an upper groove 534 into which the upper boss 517 is inserted may be formed at an upper end of an inner surface of the case 53, which corresponds thereto.

Thus, in a state in which the upper cover 51 is mounted, one end of the upper cover 51 is fixed by coupling between the upper boss 517 and the upper groove 534, and an opposite end of the upper cover 51 is fixed by the upper locker 57. Thus, a state in which the upper cover 51 is mounted may be maintained. Further, to separate the upper cover 51, after one end of the upper cover 51 is unrestrained by manipulating the upper locker 57, the upper boss 517 and the upper groove 534 are separated from each other.

A state in which the dust container cover 52 is closed may be maintained by the opening/closing mechanism 58, and the first dust collecting space 501 and the second dust collecting space (not illustrated) are opened by rotating the dust container cover 52, so that the dust in the first dust collecting space 501 and the second dust collecting space (not illustrated) may be emptied.

A dust container cover shaft 521 is formed at one end of the dust container cover 52. The dust container cover shaft 521 is rotatably coupled to a dust container cover coupling part 535 formed at a lower end of the case 53. Thus, when the dust container cover 52 is opened/closed, the dust container cover 52 is rotated about the dust container cover shaft 521.

Further, the opening/closing mechanism 58 is provided at an opposite end of the case 53, which corresponds to the dust container cover coupling part 535.

The opening/closing mechanism 58 will be described below with reference to the accompanying drawings.

Figure 8:
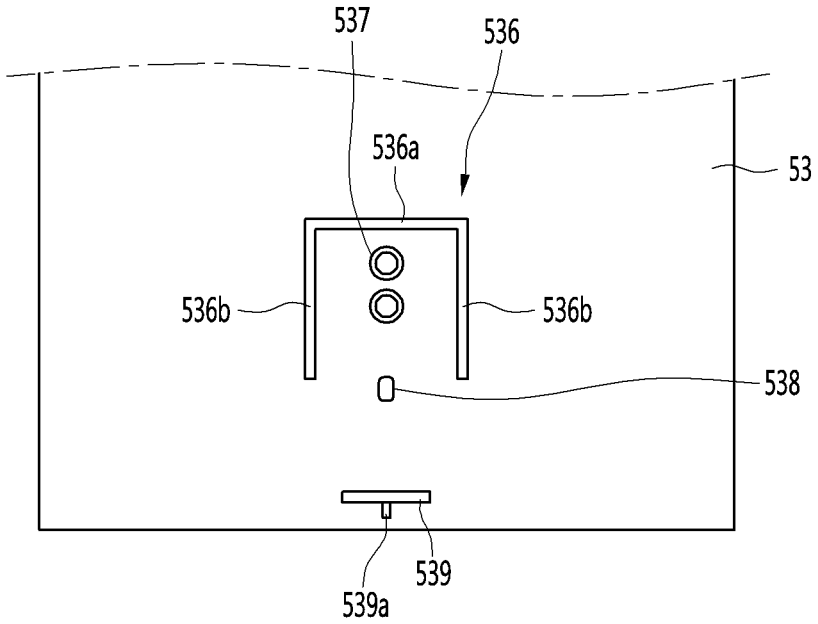
FIG. 8 is a view illustrating an installation part provided in a case according to the present disclosure.
Figure 9:
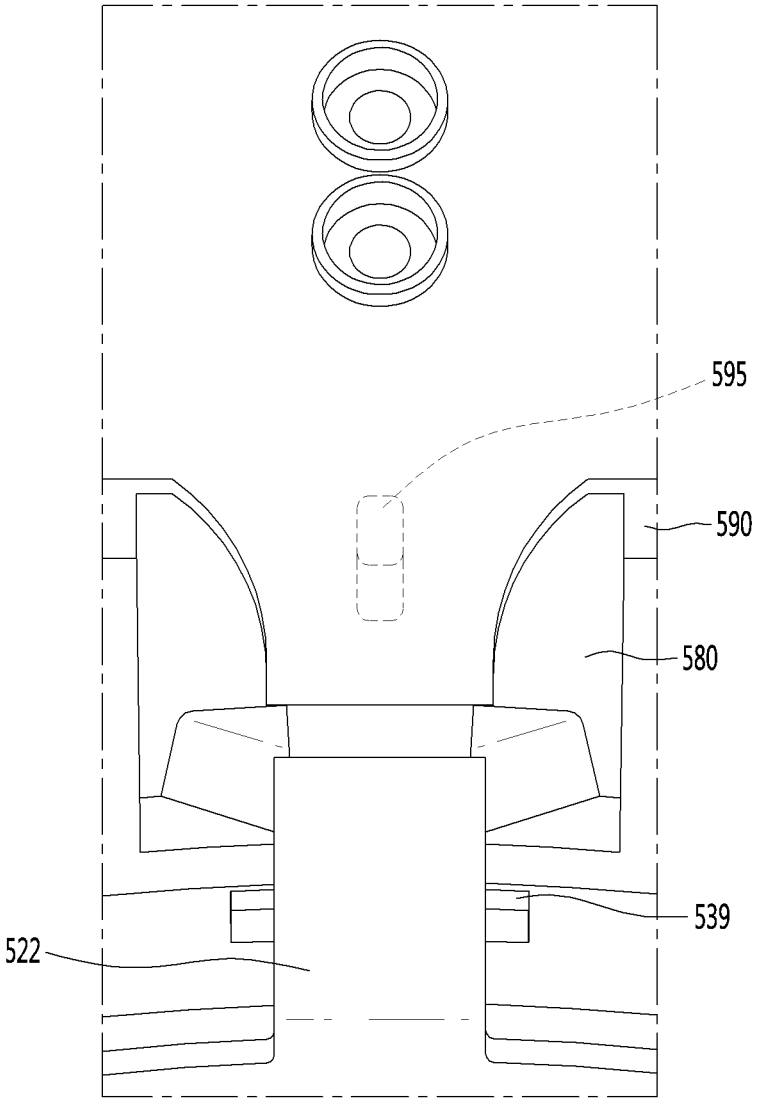
FIG. 9 is a view illustrating a state in which the opening/closing mechanism is coupled to the case according to the present disclosure.

FIG. 8 is a view illustrating an installation part provided in a case according to the present disclosure, and FIG. is a view illustrating a state in which the opening/closing mechanism is coupled to the case according to the present disclosure.

Figure 10:
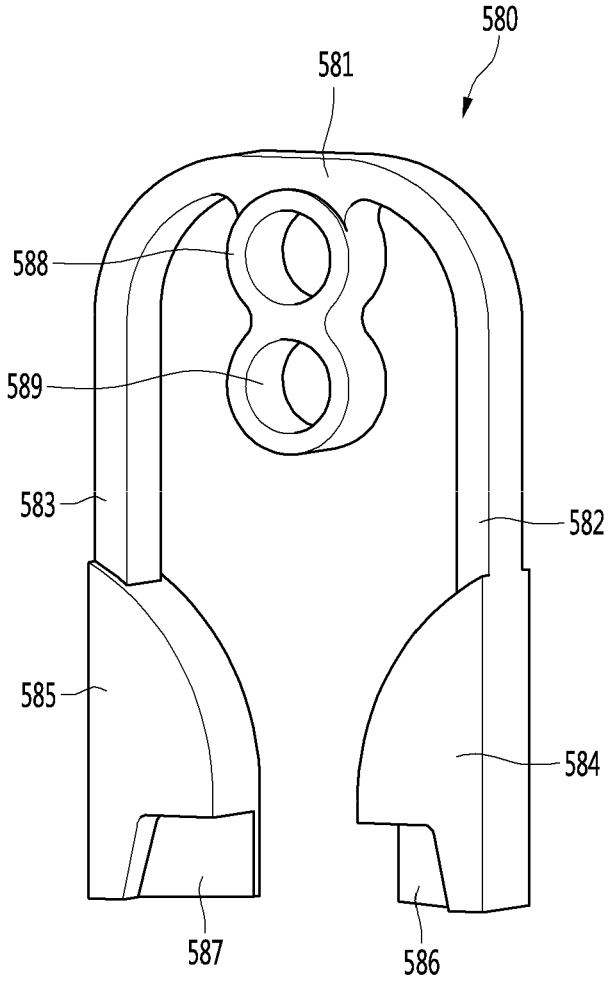
FIG. 10 is a perspective view illustrating an opening/closing part according to the present disclosure.
Figure 11:
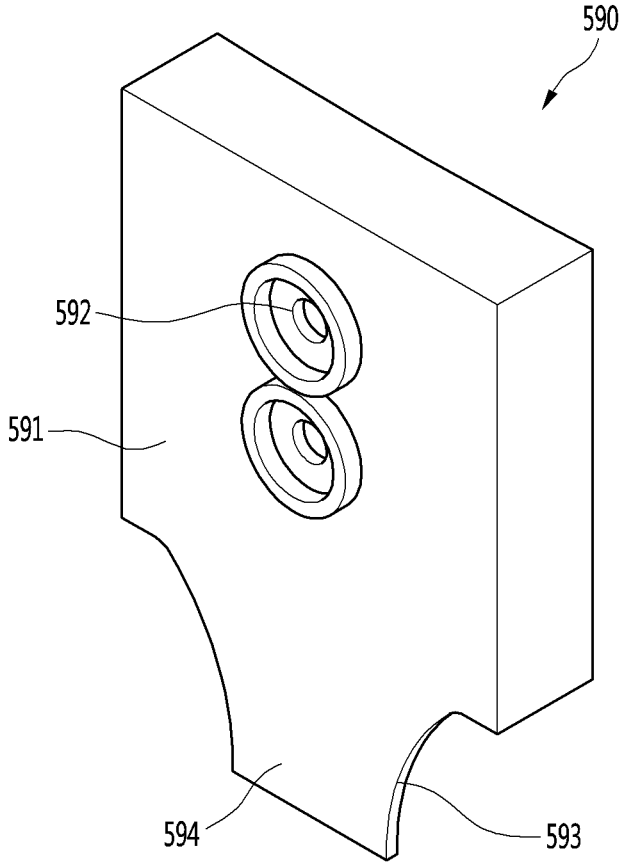
FIG. 11 is a perspective view illustrating a fixing part according to the present disclosure.
Figure 12:
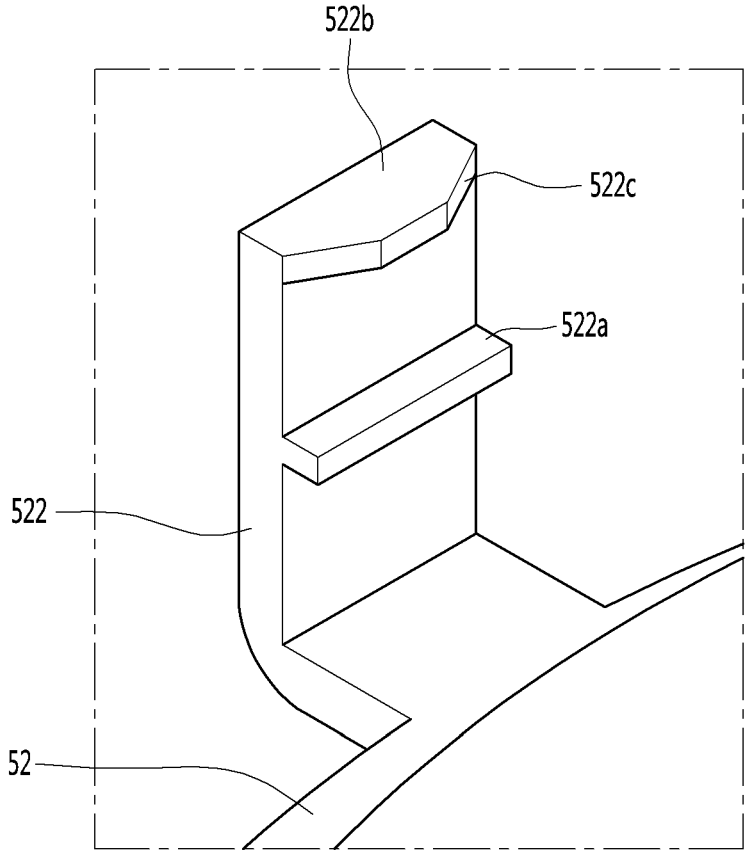
FIG. 12 is a view illustrating a cover locker of the dust container cover.

FIG. 10 is a perspective view illustrating an opening/closing part according to the present disclosure, FIG. 11 is a perspective view illustrating a fixing part according to the present disclosure, and FIG. 12 is a view illustrating a cover locker of the dust container cover.

Referring to FIGS. 8 to 12, the opening/closing mechanism 58 according to the present disclosure may include an opening/closing part 580 that may be manipulated by the user and a fixing part 590 configured to fix the opening/closing part 580 to the case 53.

The opening/closing part 580 may include a body part 581 and a pair of push parts extending from opposite ends of the body part 581 in a direction in which the push parts intersect the body part 581.

While being elastically deformed, the pair of push parts may press the cover locker 522 such that the cover locker 522 of the dust container cover 52 becomes further away from the case 53.

As an example, the pair of push parts may extend downwards from the body part 581. Thus, the pair of push parts may be arranged to be vertically spaced apart from each other.

The pair of push parts may include a pair of extensions 582 and 583.

Because the pair of extensions 582 and 583 extend from the body part 581 while being spaced apart from each other, the pair of the extensions 582 and 583 may be elastically deformed with respect to the body part 581.

Here, when the pair of extensions 582 and 583 are elastically deformed with respect to the body part 581, connection portions between the body part 581 and the pair of extensions 582 and 583 may be rounded such that the extensions 582 and 583 are easily elastically deformed while a damage thereof is prevented.

The pair of push parts may further include a pair of contact parts 584 and 585 provided at ends of the pair of extensions 582 and 583, respectively.

When the pair of contact parts 584 and 585 are elastically deformed by the pair of extensions 582 and 583, the pair of contact parts 584 and 585 may be in contact with the cover locker 522 provided in the dust container cover 52.

While the pair of contact parts 584 and 585 may be elastically deformed by the pair of extensions 582 and 583, a left-right width of each of the pair of contact parts 584 and 585 may be larger than a left-right width between the pair of extensions 582 and 583 such that the pair of contact parts 584 and 585 are in contact with the cover locker 522 while the pair of extensions 582 and 583 are elastically deformed.

If the left-right width of each of the pair of contact parts 584 and 585 is larger than a left-right width between the pair of extensions 582 and 583, when each of the pair of contact parts 584 and 585 is in contact with the cover locker 522, the pair of contact parts 584 and 585 may be prevented from being deformed or damaged.

The minimum interval between the pair of contact parts 584 and 585 is smaller than the minimum interval between the pair of extensions 582 and 583. Thus, even when deformation amounts of the pair of extensions 582 and 583 are small, each of the pair of the contact parts 584 and 585 may be in contact with the cover locker 522.

Inclined surfaces 586 and 587 allowing the cover locker 522 to become farther away from the case 53 when elastic deformation amounts of the pair of extensions 582 and 583 are increased may be provided in the pair of contact parts 584 and 585, respectively.

The inclined surfaces 586 and 587 may be inclined in a direction in which the inclined surfaces 586 and 587 become closer to the case 53 as the contact parts 584 and 585 become closer to each other.

The opening/closing part 580 may further include a coupling part 588 extending from the body part 581. The coupling part 588 may extend downwards from the body part 581 and may be located between the pair of extensions 582 and 583.

The coupling part 588 may have one or more holes 589 through which a fastening member such as a screw is to pass. However, the coupling part 588 may include a plurality of holes 589 such that the opening/closing part 580 and the case 53 are firmly fixed to each other.

An installation part in which the opening/closing part 580 is to be installed may be provided in the case 53.

The installation part may include a guide rib 536 protruding from the case 53 and configured to determine locations of the push parts.

Further, the guide rib 536 may allow the push parts to be deformable in one direction and to be restrained from being deformed in an opposite direction.

The guide rib 536 may include a first rib 536*a* which the body part 581 is in contact with.

The first rib 536*a* may extend from the case 53 in a horizontal direction. The guide rib 536 may further include a second rib 536*b* and a third rib 536*c* extending downwards from opposite ends of the first rib 536*a*.

The first extension 582 of the pair of extensions 582 and 583 is in contact with the second rib 536*b*, and the second extension 583 of the pair of the extensions 582 and 583 is in contact with the third rib 536*c*.

The second rib 536*b* and the third rib 536*c* may be in parallel to each other. The pair of extensions 582 and 583 may be located between the second rib 536*b* and the third rib 536*c* such that the extensions 582 and 583 may be deformed only in a direction in which the extensions 582 and 583 are closer to each other when external force is applied to the extensions 582 and 583 in a state in which external force is not applied to the extensions 582 and 583.

That is, a minimum distance between the second rib 536*b* and the third rib 536*c* may be equal to or larger than a maximum distance between the pair of extensions 582 and 583.

Lengths of the second rib 536*b* and the third rib 536*c* are formed to be smaller than lengths of the push parts such that the user may press the contact parts 584 and 585 from the outsides of the contact parts 584 and 585.

The lengths of the second rib 536*b* and the third rib 536*c* may be equal to or similar to the lengths of the extensions 582 and 583.

One or more fastening bosses 537 to which fastening members passing through the holes 589 of the opening/closing part 580 are fastened may be provided in the case 53. The one or more fastening bosses 537 may be located in an area formed by the guide rib 536. That is, the one or more fastening bosses 537 may be located between the second rib 536*b* and the third rib 536*c*.

The outer diameter of the one or more fastening bosses 537 may be equal to the inner diameter of the holes 589 of the opening/closing part 580. In this case, the one or more fastening bosses 537 may be fitted in the holes 589 of the opening/closing part 580.

The one or more fastening bosses 537 may be spaced apart from the first rib 536*a* such that the body part 581 may be located between the one or more fastening bosses 537 and the first rib 536*a*.

A boss 539 by which the cover locker 522 is to be caught may be provided below the guide rib 536 in the case 53.

The boss 539 may extend from the case 53 in a horizontal direction, and a reinforcement boss 539*a* may be formed below the boss 539 to prevent the boss 539 from being damaged.

The fixing part 590 may include a fixing body 591 covering the opening/closing part 580. In a state in which the fixing body 591 covers the opening/closing part 580, the fixing body 591 may be in contact with the first rib to the third rib 536*a*, 536*b* and 536*c*.

Fastening holes 592 through which the fastening members to be fastened to the fastening bosses 537 pass may be formed in the fixing body 591.

Cut grooves 593 are formed on opposite lower sides of the fixing body 591 such that the contact parts 584 and 585 are exposed to the outside in a state in which the fixing body 591 covers the opening/closing part 580.

Because the pair of contact parts 584 and 585 are exposed to the outside in a state in which the fixing body 591 is fixed to the case 53, the user may manipulate the pair of contact parts 584 and 585 exposed to the outside.

A portion between the pair of cut grooves 593 of the fixing body 591 serves as a space cover 594 configured to cover a space between the pair of contact parts 584 and 585. As the space cover 594 covers the space between the pair of contact parts 584 and 585, foreign substances introduced into the pair of contact parts 584 and 585 may be minimized.

In a state in which the fixing body 591 is fixed to the case 53, the space cover 594 is vertically spaced apart from the cover locker 522 of the dust container cover 52.

The pair of contact parts 584 and 585 extend toward a lower side of the space cover 594, and lower ends of the contact parts 584 and 585 are located to be lower than an upper end of the cover locker 522.

To prevent the space cover 594 from being deformed and damaged toward the case 53, a first boss 538 may be formed in the case 53, and a second boss 595 facing the first boss 538 may be provided in the space cover 594.

The second boss 595 may be continuously in contact with the first boss 538 or the second boss 595 may come into contact with the first boss 538 while the space cover 594 is deformed toward the case 53.

The second boss 595 and the first boss 538 are located between the pair of contact parts 584 and 585, and are spaced apart from the pair of contact parts 584 and 585 even in a state in which the pair of contact parts 584 and 585 are maximally deformed.

Meanwhile, the dust container cover 52 may include the cover locker 522. The cover locker 522 may extend upwards from the dust container cover 52.

The cover locker 522 may include a rib 522*a* caught by the boss 539 of the case 53. The rib 522*a* is seated on an upper end of the boss 539. In this state, the dust container cover 52 is prevented from being opened.

Further, only when the cover locker 522 moves in a direction in which the cover locker 522 becomes farther away from the case 53, the rib 522*a* is spaced apart from the boss 539, so that a state in which the dust container cover 52 may be opened is achieved.

The cover locker 522 may further include a guide 522*b* in contact with the contact parts 584 and 585 to guide release of catching of the cover locker 522.

The guide 522*b* is located above the rib 522*a* and is spaced apart from the rib 522*a*.

Inclined surfaces 522*c* in contact with the inclined surfaces 586 and 587 of the contact parts 584 and 585 may be formed on opposite sides of the guide 522*b*.

When the inclined surfaces 522*c* are formed in the guide 522*b*, reference deformation amounts of the contact parts 584 and 585, which are required to release catching between the rib 522*a* and the boss 539, may be increased.

As the reference deformation amounts of the contact parts 584 and 585 become smaller, force required for opening the dust container cover may be reduced. However, when external force is applied to the contact parts 584 and 585 in a state in which the user does not manipulate the vacuum cleaner 1, the dust container cover may be unintentionally opened.

Thus, it is preferable that the reference deformation amounts of the contact parts 584 and 585 are set such that the contact parts 584 and 585 may be deformed by simple manipulation of the user.

Hereinafter, a process of opening the dust container cover will be described.

Figure 13:
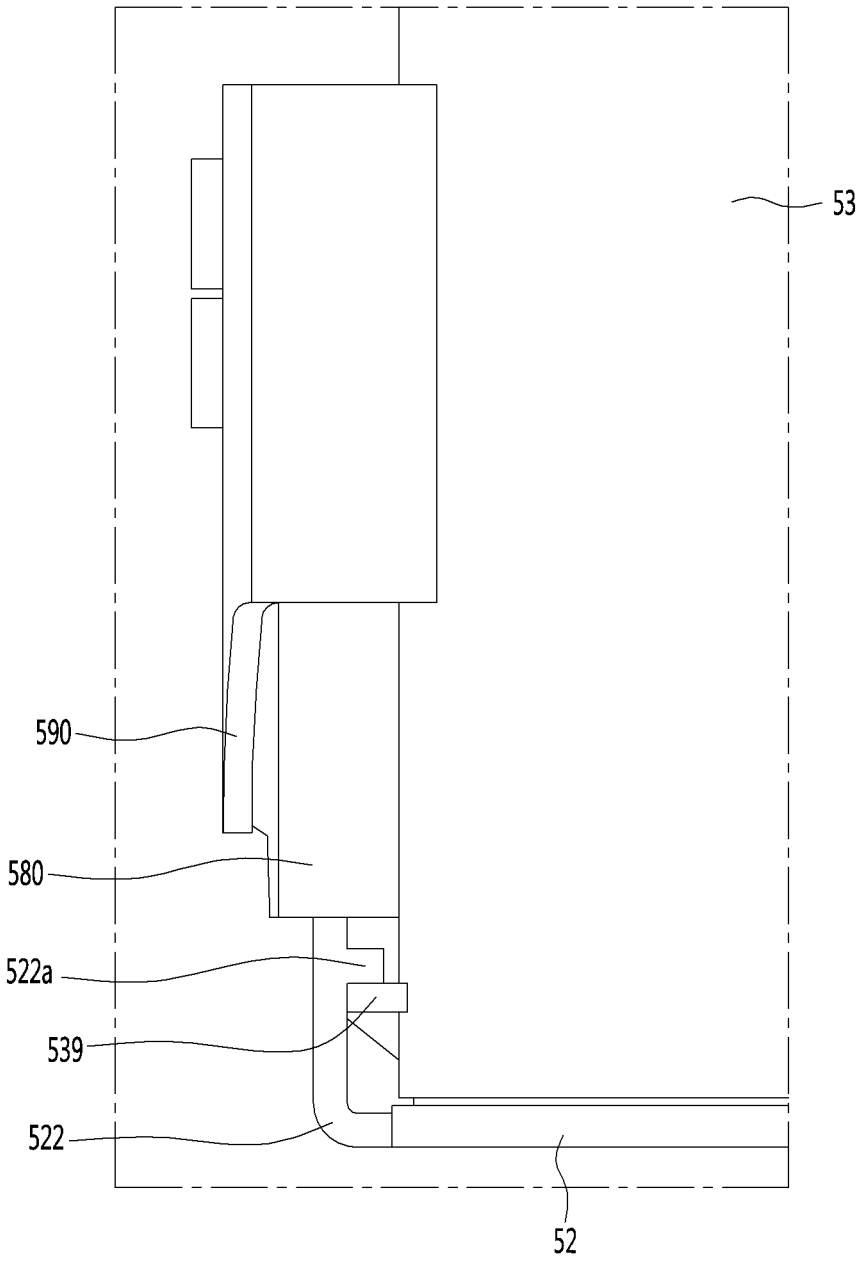
FIG. 13 is a view illustrating a state in which the dust container cover is coupled to the case.
Figure 14:
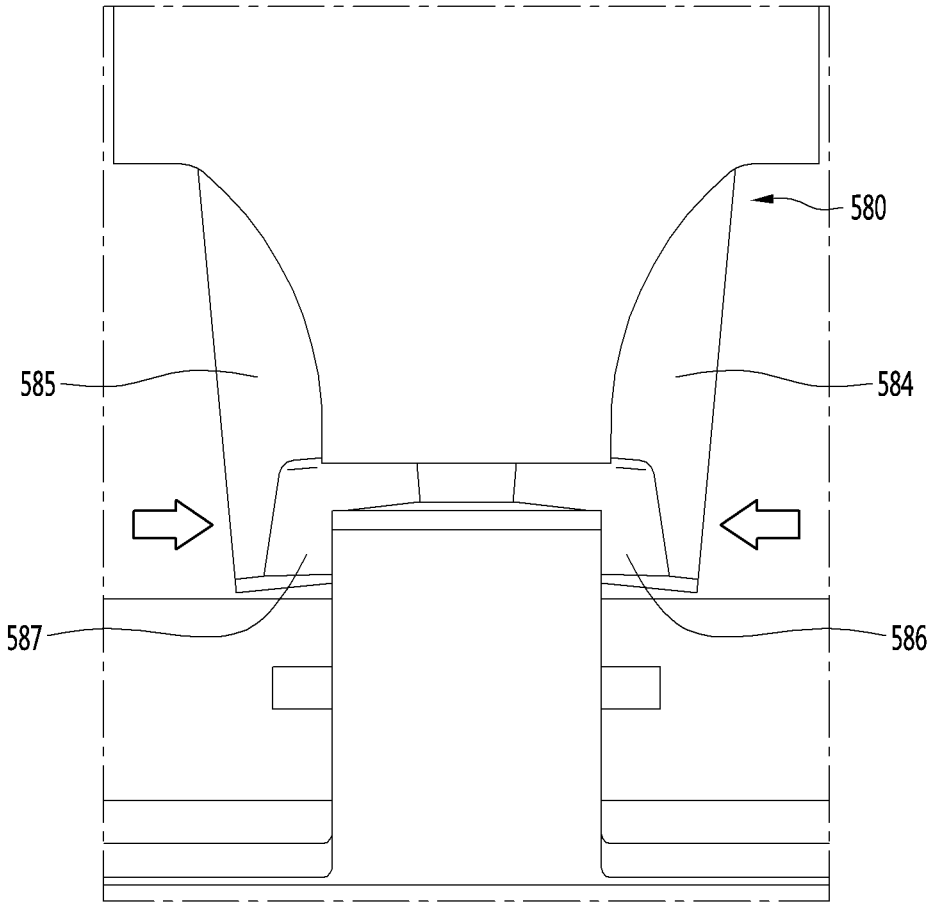
FIG. 14 is a view illustrating a state in which push parts are manipulated to open the dust container cover.
Figure 15:
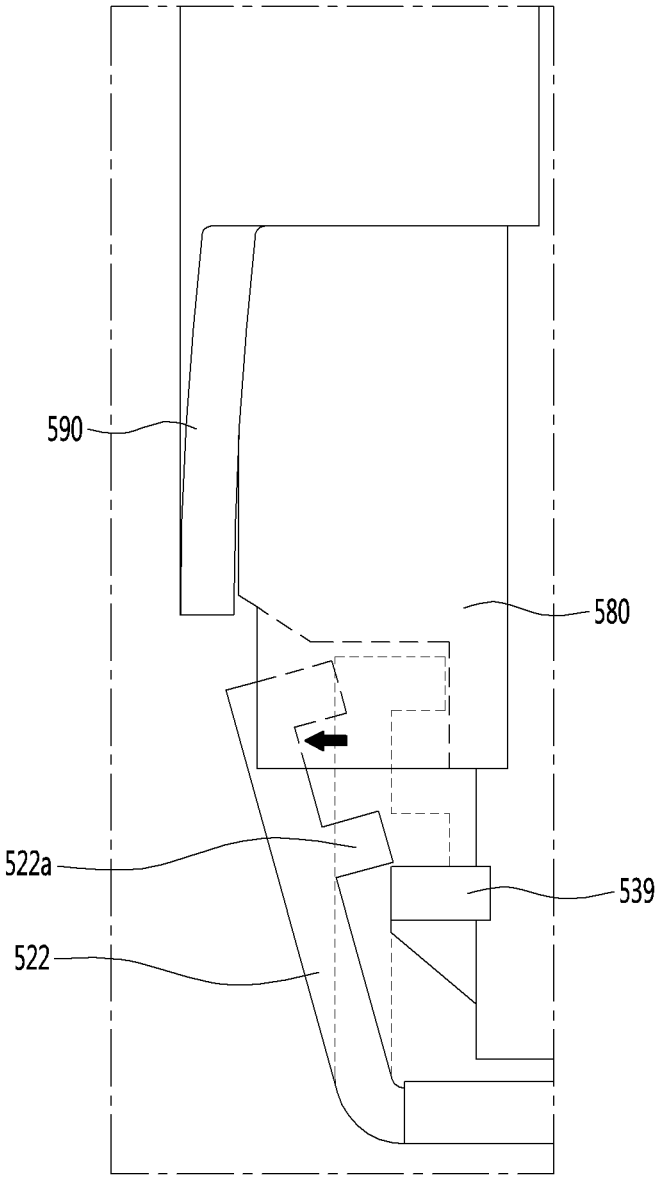
FIG. 15 is a view illustrating a state in which catching between a rib of the cover locker and a boss of the case is released.

FIG. 13 is a view illustrating a state in which the dust container cover is coupled to the case, FIG. 14 is a view illustrating a state in which push parts are manipulated to open the dust container cover, and FIG. 15 is a view illustrating a state in which catching between a rib of the cover locker and a boss of the case is released.

Referring to FIG. 9 and FIGS. 13 to 15, in a state in which external force is not applied to the opening/closing part 580, a state in which the rib 522*a* of the cover locker 522 is caught by the boss 539 is maintained, and the pair of contact parts 584 and 585 are exposed to the outside.

Here, a state in which the inclined surfaces 586 and 587 of the contact parts 584 and 585 are in contact with the inclined surfaces 522*c* of the guide 522*b* may be maintained.

To open the dust container cover 52, the user may press the pair of contact parts 584 and 585 in a direction in which the contact parts 584 and 585 become closer to each other.

When the pair of contact parts 584 and 585 are moved in the direction in which the contact parts 584 and 585 become closer to each other, the inclined surfaces 586 and 587 of the pair of contact parts 584 and 585 are slid with the inclined surfaces 522*c* of the guide 522*b*, so that the cover locker 522 is deformed in a direction in which the cover locker 522 becomes farther away from the case 53. Then, the catching between the rib 522*a* of the cover locker 522 and the boss 539 is released, so that the dust container cover 52 is rotated by a self-weight thereof to open the case 53.

Meanwhile, when the external force applied to the pair of contact parts 584 and 585 is removed, the pair of contact parts 584 and 585 are moved by elastic restoring force in a direction in which the contact parts 584 and 585 become farther away from each other, and thus return to original positions thereof.

According to the present disclosure, as the opening/closing part itself is provided to be elastically deformed, a process of assembling the opening/closing part with the dust container is easy.

Further, because the opening/closing part includes the pair of elastically deformable push parts, the user may manipulate the opening/closing part regardless of whether the user is a left-handed person or a right-handed person.

Further, because the dust container cover is opened/closed only by an operation of pressing the opening/closing part using two fingers, the dust container cover is easily opened.

What is claimed is:

1. A vacuum cleaner comprising:

a cleaner body;

a suction device configured to suction air and dust and to guide the suctioned air and dust to the cleaner body; and a dust container configured to receive the dust that has been suctioned through the suction device, the dust container including:

a case defining a dust collecting space configured to receive the dust, the case including a first boss and a coupling boss that protrude from an outer surface of the case, the coupling boss extending in a horizontal direction, a dust container cover rotatably connected to the case and configured to open and close the dust collecting space, the dust container cover including a cover locker configured to catch the coupling boss of the case, an opening/closing part that is configured to open the dust container cover and that includes a pair of push parts the pair of push parts being coupled to the case and configured to deform to become closer to each other, and a fixing part that couples to the case and that covers a portion of the opening/closing part, the fixing part including a second boss that faces the first boss of the case and that is configured to contact the first boss of the case to limit deformation of the fixing part toward the case, wherein the cover locker is configured to deform to be released from the coupling boss based on the pair of push parts deforming to become closer to each other.

2. The vacuum cleaner of claim 1, wherein the opening/closing part further comprises a body part from which the pair of push parts extend in a direction transverse to the body part, and wherein the pair of push parts are spaced apart from each other.

3. The vacuum cleaner of claim 2, wherein the case includes a guide rib that defines a mounting position of the pair of push parts and that is configured to limit deformation of the pair of push parts becoming farther from each other.

4. The vacuum cleaner of claim 3, wherein the guide rib comprises:

a first rib that contacts the body part of the opening/closing part; and a second rib and a third rib that extend from opposite sides of the first rib and that contact the pair of push parts, respectively.

5. The vacuum cleaner of claim 4, wherein the second rib and the third rib are parallel to each other, and wherein the pair of push parts are located between the second rib and the third rib.

6. The vacuum cleaner of claim 4, wherein the opening/closing part further comprises a coupling part extending from the body part and defining a hole configured to receive a fastening member, wherein the case further comprises a fastening boss that is spaced apart from the first rib and that is located between the second rib and the third rib, and wherein the fastening boss is aligned to the hole of the coupling part and configured to receive the fastening member.

7. The vacuum cleaner of claim 1, wherein the fixing part defines cut grooves that expose portions of the pair of push parts to an outside.

8. The vacuum cleaner of claim 1, wherein the cover locker extends upward from the dust container cover with respect to ground.

9. The vacuum cleaner of claim 1, wherein the cover locker is configured to become farther from the case based on deformation of the pair of push parts that press the cover locker.

10. The vacuum cleaner of claim 1, wherein the cleaner body includes a seating part provided at a front side of the cleaner body and configured to mount the dust container, and wherein the dust container defines a portion of a front surface of the cleaner body based on the dust container being mounted on the seating part.

11. The vacuum cleaner of claim 10, wherein the cleaner body comprises:

a main body; and a cover member configured to cover at least a portion of the dust container based on the cover member covering an upper portion of the main body.

12. The vacuum cleaner of claim 1, wherein the dust container further includes a suction port that is defined at an upper portion of the dust container and that faces a front side of the dust container.

13. The vacuum cleaner of claim 1, wherein the dust container further includes an upper cover configured to open and close an upper opening at an upper portion of the case, and wherein the dust container cover is configured to open and close a lower opening at a lower end of the case.

14. The vacuum cleaner of claim 1, wherein the pair of push parts are configured to elastically deform from a first positions based on an external force applied by a user, and to return to the first positions by a restoring force generated by the pair of push parts based on the external force being removed, wherein the cover locker comprises:

a rib that protrudes from an inner surface of the cover locker toward the case, that extends in the horizontal direction parallel to the coupling boss of the case, and that is configured to be seated on an upper end of the coupling boss of the case based on the dust container cover closing the dust collecting space, and a guide that protrudes from the inner surface of the cover locker, that is located vertically above the rib, and that is configured to contact the pair of push parts, the guide of the cover locker including inclined guide surfaces that face toward the dust container and laterally outward of the cover locker, and wherein the pair of push parts are configured to, based on moving closer to each other, slide on the inclined guide surfaces of the guide and cause the cover locker to move in a direction away from the case.

15. The vacuum cleaner of claim 14, wherein the opening/closing part further comprises a body part, and wherein each of the pair of push parts comprises:

an extension extending from the body part, and a contact part provided at an end of the extension and having a width larger than a width of the extension, and wherein each contact part includes an inclined surface that contacts one of the inclined guide surfaces of the guide.

16. The vacuum cleaner of claim 15, wherein a minimum distance between contact parts of the pair of push parts is less than a minimum distance between extensions of the pair of push parts.

17. The vacuum cleaner of claim 15, wherein the inclined surface of each contact part slopes with respect to a surface of the case in a direction in which the inclined surface of each contact part becomes closer to the surface of the case toward an end portion facing space defined between the contact parts.

18. The vacuum cleaner of claim 14, wherein the rib comprises:

a lower surface configured to be seated on the upper end of the coupling boss of the case; and a rear surface configured to, based on the lower surface being seated on the upper end of the coupling boss of the case, face the outer surface of the case and be spaced apart from the outer surface of the case.

19. The vacuum cleaner of claim 1, wherein the fixing part comprises:

an upper end that contacts the outer surface of the case; and a space cover that is disposed at a lower portion of the fixing part, that is spaced apart from the outer surface of the case, and that is configured to cover the pair of push parts, and wherein the second boss protrudes from a rear surface of the space cover that faces the outer surface of the case.

20. The vacuum cleaner of claim 19, wherein the first boss of the case is spaced apart from the coupling boss of the case and disposed vertically above the coupling boss of the case, and wherein the space cover of the fixing part covers the first boss of the case.

* * * * *